US007017849B2

(12) United States Patent
Fuchs et al.

(10) Patent No.: US 7,017,849 B2
(45) Date of Patent: Mar. 28, 2006

(54) ELECTROMAGNETIC BRAKE IN A SLITTER

(75) Inventors: Lawrence J. Fuchs, Denmark, WI (US); Michael J. Daul, Appleton, WI (US)

(73) Assignee: Metso Paper, Inc., Helsinki (FI)

( * ) Notice: Subject to any disclaimer, the term of this patent is extended or adjusted under 35 U.S.C. 154(b) by 73 days.

(21) Appl. No.: 10/395,042

(22) Filed: Mar. 21, 2003

(65) Prior Publication Data

US 2004/0182965 A1 Sep. 23, 2004

(51) Int. Cl.
*B65H 23/10* (2006.01)
*B65H 23/26* (2006.01)

(52) U.S. Cl. ..... 242/419.9; 242/419.3; 242/156.1; 242/156.2

(58) Field of Classification Search ..... 242/419.9, 242/156.1, 156.2, 534, 419.3
See application file for complete search history.

(56) References Cited

U.S. PATENT DOCUMENTS 3,217,999 A 11/1965 McDonald
3,433,398 A * 3/1969 Moore et al. ..... 226/93
3,778,005 A 12/1973 Grüniger et al.
3,841,580 A * 10/1974 Rodach ..... 242/419.9
4,444,363 A 4/1984 Jacquel et al.
4,650,133 A * 3/1987 White et al. ..... 242/412.3
4,853,573 A 8/1989 Wolcott et al.
5,234,177 A 8/1993 Maji et al.
5,524,834 A 6/1996 Bogucki-Land
5,567,269 A * 10/1996 Golightly ..... 156/361
5,794,869 A 8/1998 Takano et al.
5,919,333 A * 7/1999 Maltby et al. ..... 156/425
6,244,395 B1 6/2001 Schlagenhaft

OTHER PUBLICATIONS

Torspec™ Eddy Current Brakes, company pamphlet.
Scott B. Hughes, "Magnetic braking: Finding the effective length over which the eddy currents form", Physics Department, The College of Wooster, Wooster, Ohio 44691, May 5, 2000.

* cited by examiner

*Primary Examiner*—Kathy Matecki
*Assistant Examiner*—Sang Kim

(57) ABSTRACT

An idler roll brake in a paper handing machine employs an electromagnet positioned close to the periphery all of the idler roll which interacts with and induces eddy currents a conducive roll and a gear shaped steel ring fitted within the conducive roll. The electromagnet is arranged transverse to the axis of the roll and has three poles. The gear-shaped steel ring forms opposite poles which are attracted to the poles of the electromagnet which bring the roll to complete stop. An alternative embodiment roll brake employs a brake shoe mounted to the roll end bearing. The brake shoe slides forward to bring the brake shoe against the interior surface of the roll. An electromagnet positioned beneath the roll attracts a ferromagnetic armature or permanent magnet mounted to the brake to pull the brake shoe into engagement with the inner surface of the roll.

8 Claims, 3 Drawing Sheets

ELECTROMAGNETIC BRAKE IN A SLITTER

CROSS REFERENCES TO RELATED APPLICATIONS

Not applicable.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The present invention relates to rolls in paper handling machines, such as slitters, which are driven only by the web and to the brakes for stopping the rotation of such rolls when the paper web breaks.

Paper is manufactured in widths of up to 300 inches or more and wound into machine rolls which may weigh over 120,000 lbs. The machine rolls are removed from the papermaking machine as they are formed. Further processing of the machine roll to create smaller rolls or individual sheets of paper is preformed by other machines. The machine roll can be processed by sending the web through a group of slitters which cut the web into a plurality of narrower webs typically through the use of rotating circular knives. Paper webs are processed at speeds of up to 10,000 feet per minute. As the paper travels from the unwind station to the winder station, it passes over idler rolls to guide the web as it is fed into the rotating knives of the slitter.

For simplicity, the idler rolls have no drive and are simply free turning on internal bearings. As the web is drawn over the idler rolls, the rolls rotate with the speed dictated by the speed of the paper. If the paper web breaks in the slitter, it is often necessary to manually clean out broke from the slitting machine. However, the rapidly turning idler rolls may continue to rotate at several thousand RPM for a relatively long period of time. Waiting for the idler rolls to stop turning would result in the loss of valuable production time if a mechanism were not available to bring the idler rolls to a rapid stop. In existing machines a wheel can be brought into engagement with the idler rolls. The wheel is connected by a clutch brake and brings the roll to a stop. However, such braking wheels are subject to wear and contact the exterior surface of the idler roll. What is needed is a low maintenance brake without moving parts or one in which braking forces are exerted on the interior of the roll.

SUMMARY OF THE INVENTION

The idler roll brake of this invention is used in a slitting machine, or other paper handling machine, such as a winder, or a coater. The roll brake employs an electromagnet positioned external to, and close to the periphery of the idler roll. They electromagnetic brake interacts with a conductive aluminum roll, and a gear shaped steel or iron ring fitted within the aluminum roll. The electromagnet induces eddy currents in the conductive shell of the roll which produce magnetic fields in opposition to the applied magnetic field which results in a braking force applied to the roll. The energy of the rotating roll is converted into heat in the surface of at least the aluminum roll. The electromagnet is arranged transverse to the axis of the roll and the poles are positioned adjacent the surface of the roll. The gear shaped steel ring forms opposite poles which are attracted to the poles of the electromagnet intensifying the magnetic field through the aluminum shell. The attraction between the steel ring teeth and the electromagnetic poles bring the roll to a complete stop with the electromagnetic poles and the steel ring poles aligned. The brake may, for example, consist of a 400 Watt 120 V DC electromagnet positioned adjacent to an aluminum roll 7.8 inches in diameter, thirty-eight inches in length, and having a moment of inertia of about 4.5 lb $ft^2$. The electromagnet has three ferromagnetic pole pieces with coils positioned therebetween. The three pole pieces and the magnet are positioned transverse to the axis defined by the aluminum roll. Positioned internal to the roll is a steel gear with teeth spaced apart so as to line up with the three pole pieces. Actuation of the electromagnet will bring a roll turning at up to 5000 RPM to a stop in less than one minute. The attraction between the gear teeth of the steel backing ring and the poles of electromagnet assure that the roll comes to a complete stop with individual teeth positioned over each of the three poles.

An alternative embodiment roll brake employs a brake shoe mounted to a roll end bearing. The brake shoe is positioned by one or more guides to slide forward to bring the brake shoe into engagement with the interior surface of the roll. An electromagnet positioned beneath the roll attracts a ferromagnetic armature or permanent magnet mounted to the brake to pull the brake shoe into engagement with the interior surface of the roll with a force of 10 to 20 pounds.

It is a feature of the present invention to provide a brake for an idler roll which does not contact the roll.

It is another feature of the present invention to provide a brake for an idler roll which requires less maintenance.

It is a further feature of the present invention to provide a brake for an idler roll which requires a reduced part count.

Further objects, features and advantages of the invention will be apparent from the following detailed description when taken in conjunction with the accompanying drawings.

DESCRIPTION OF THE PREFERRED EMBODIMENTS

Figure 1:
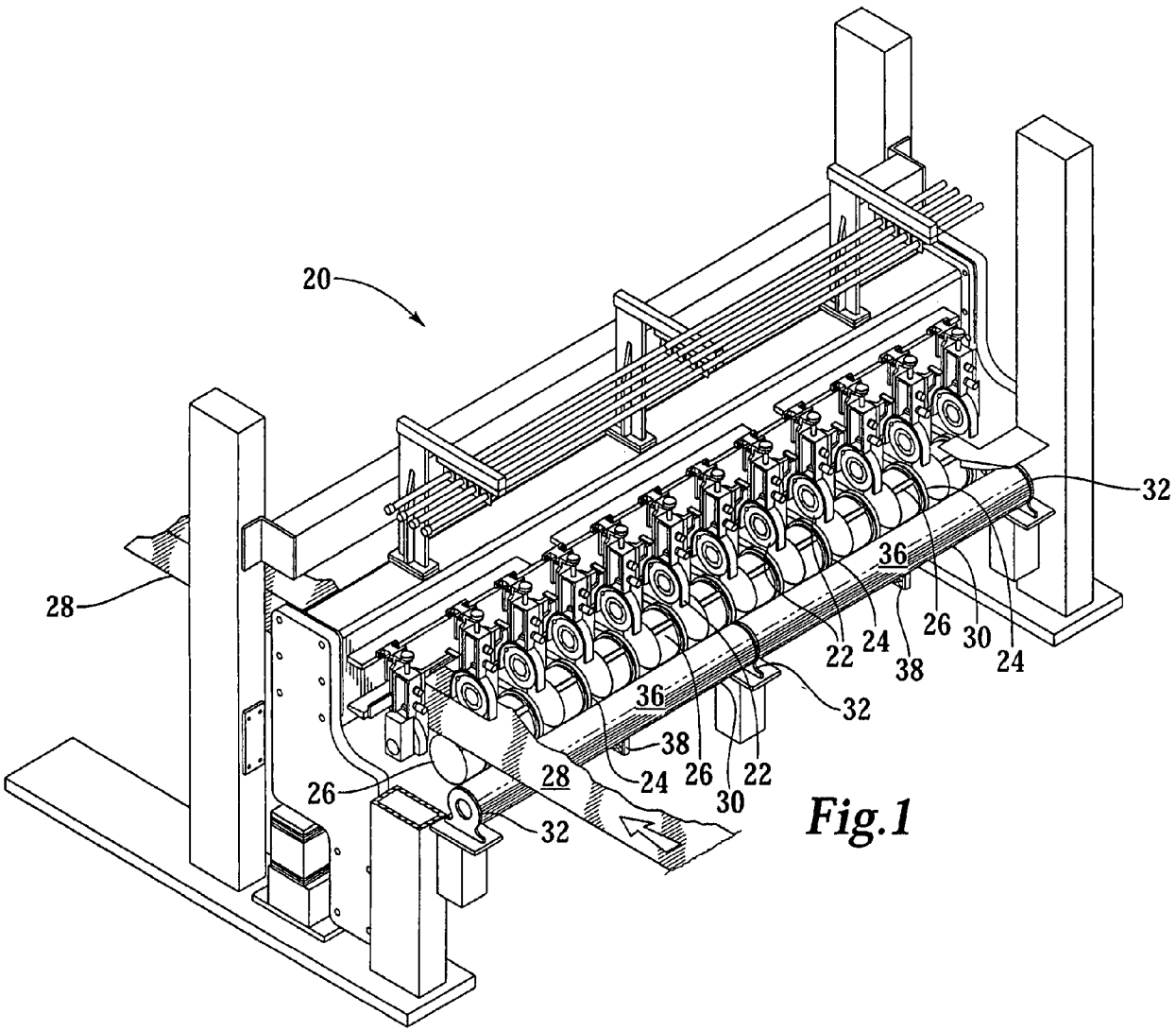
FIG. 1 is an isometric view of the paper slitter employing the roll brake of this invention.

Referring more particularly to FIGS. 1–5 wherein like numbers refer to similar parts, a slitter 20 is shown in FIG. 1. The slitter 20 has a multiplicity of slitter blades 22 which engage with bottom bands 24 driven by motors 26. During operation, a slitter blade 22 is positioned or "side loaded" so that it tightly engages the side edge of a bottom band 24. The leading point of contact between a slitter blade 22 and a bottom band 24 forms a cut-point whereby the paper web is cut. As a result, each slitter blade 22 and bottom band 24 overlap to provide a scissors-like action for cutting the web as it unwinds from a roll and is pulled through the web slitter by a take-up roll.

To supply the web 28 to the contact between the slitter blades 22 and the bottom bands 24, two coaxial idler rolls 30 are supported in front of the blades 22 on the machine 20. The rolls 30 are supported on end supports 32 by bearings 34 shown in FIG. 2, and are caused to rotate by the motion of the web 28 across the outer surface 36 of the roll 30. The web can travel at up to 10,000 feet per minute, causing the rolls to rotate at 4900 RPM for rolls which are about 7.8 inches in diameter. As shown in FIG. 1, a magnetic brake 38 is positioned beneath each roll 30 but does not physically engage the roll. The magnetic brake 38 stops the roll within about 30 seconds after a web brake so that an operator can approach the machine to remove the broken web without the danger of engaging the still-turning rolls 30.

Figure 3:
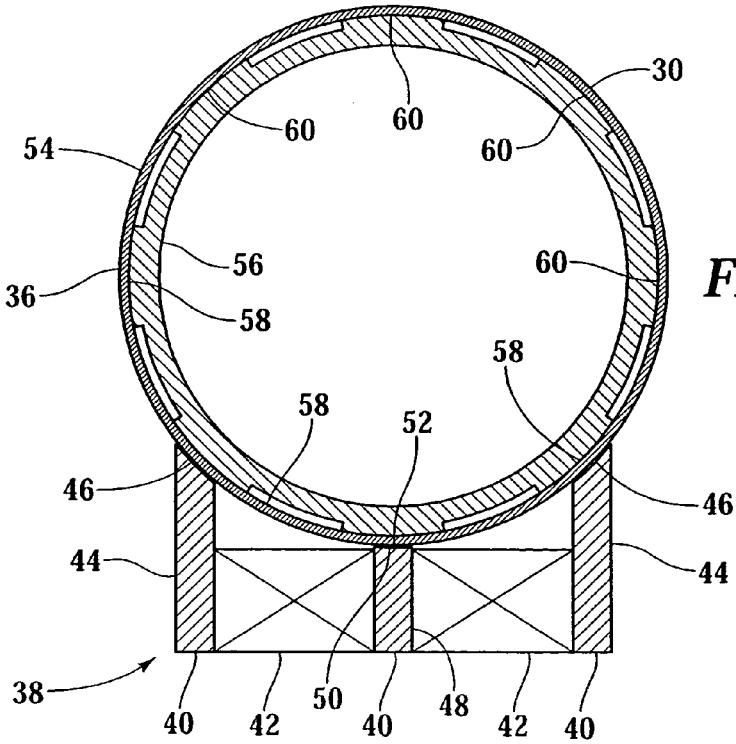
FIG. 3 is a cross-sectional view of the roll and roll brake of FIG. 2 taken along section line 3—3.

As shown in FIG. 3, the magnetic brake 38 has three poles 40 with electrical windings 42 positioned between the poles 40. The electromagnet is powered by 120 volt AC which is rectified to DC. Because the magnetic brake 38 is only required to operate for approximately 30 seconds at infrequent intervals, it may be designed with a duty cycle of five percent and a maximum continuous operating time of one minute. The magnetic brake 38 may be sized to consume 400 watts of power. The outside poles 44 have upper surfaces 46 which are shaped to allow them to be positioned tangent to the outer surface 36 of the rolls 30, and the middle pole 48 has an upper surface 50 which is tangent to the low point 52 of the rolls 30. The magnetic brake 38 is an electromagnet which induces eddy currents in the electrically conductive aluminum shell 54 of the rolls 30, and interacts with a ferromagnetic ring 56 which intensifies the applied magnetic fields which brake the rotation of the rolls 30. As the roll 30 reaches a low velocity, the attraction between the poles 40 of the electromagnet formed by the brake 38 interact with poles 58 formed by the radially outwardly extending teeth 60 on the ferrous ring 56 to bring the rolls 30 to a complete stop as shown in FIG. 3, with the outside poles 40 and to middle pole 48 aligned with the poles formed by individual teeth 60. The polls 40 are arranged with a spacing which positions of the polls beneath individual teeth of the gear. Thus the spacing the out side polls 44 from the middle poll 48 will be the sin((360/number of teeth)×(gear radius)) or in the case of 8 teeth, sin(45)×gear radius or 0.707 times the gear radius. For a larger number of polls and teeth a second set of out side poles could be used spaced at sin((360/number of teeth×2)×(gear radius)).

The electromagnetic brake 38 may be connected directly to a paper break detection system (not shown) or may be operator initiated. Using an eddy current brake results in a relatively low cost and simple system. There is no contact between the electromagnetic brake 38 and the roll 30, greatly reducing the possibility of wear and the need for maintenance. The function of the electromagnetic brake 38 is self-regulating, i.e., because the braking force is proportional to the speed of rotation of the roll 30, the faster the roll is rotating the more braking force is applied.

Figure 2:
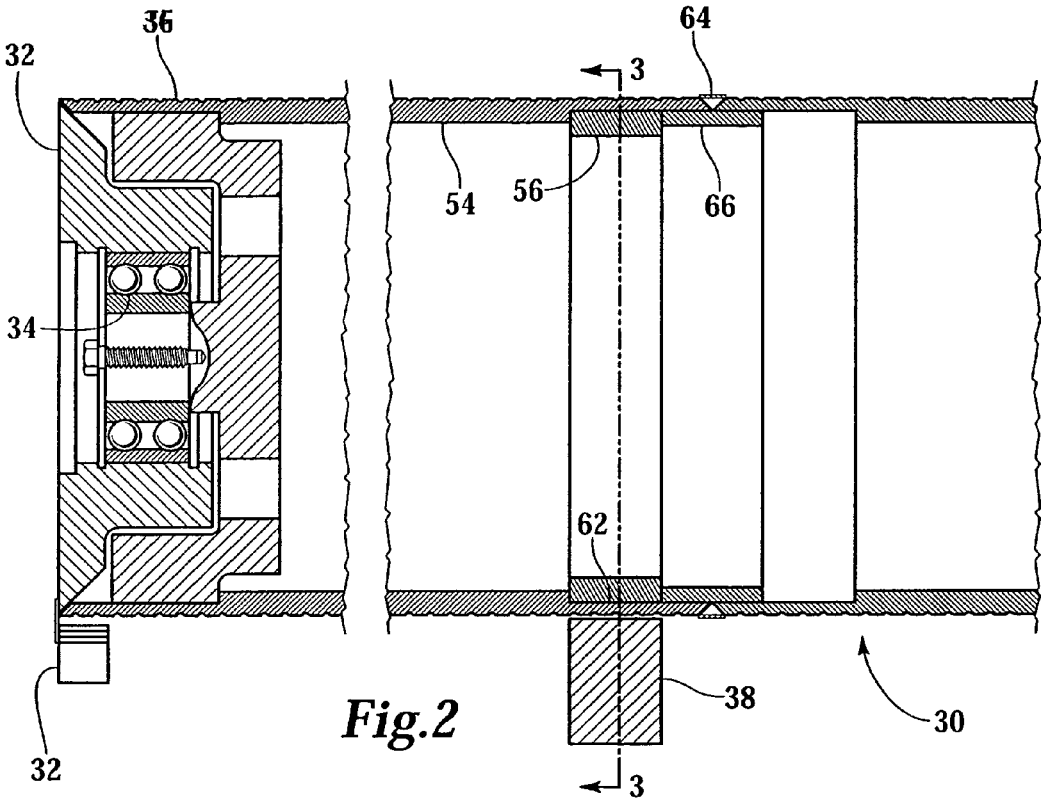
FIG. 2 is a fragmentary side elevational cross-sectional view of the roll and brake of FIG. 1.

Tests were performed using a roll configured as shown in FIGS. 2 and 3. The aluminum roll had an outer shell thirty-eight inches in length which was formed from two 19 inch roll shell segments. The diameter of the aluminum roll was 7.8 inches with a wall thickness of about 0.33 inches reduced to 0.217 inches along a central relief area 62 where the two 19 inch roll shells were welded together at a weld joint 64 backed by a weld ring 66. A cold rolled steel ring 56 having an interior diameter of 6.6 inches and an outer diameter of 7.1 inches with radially projecting teeth having a diameter of 7.4 inches was press fit in the central relief area 62. The steel ring 56 had an axial length of 1.375 inches. An electromagnet 38 of 400 watts 120 volt dc 5% duty cycle procured from Magnetech Corporation of Novi, Mich., was positioned as illustrated in FIG. 3. Test runs were initiated by spinning up the roll and turning on the electromagnet 38. The results are tabulated in the table. Because of limitations of the test setup, maximum roll speed was about 2000 RPM, but a linear extrapolation of the data indicates that the magnet would bring a 4,900 RPM or 10,000 feet-per-minute roll to rest in about 38 seconds.

| Test Run | Roll Speed (ft/min) | Roll Speed (RPM) | Time required to Stop Roll |
|---|---|---|---|
| 1 | 3000 | 1470 | 10 seconds |
| 2 | 2500 | 1224 | 9 seconds |
| 3 | 2000 | 980 | 7.5 seconds |
| 4 | 1000 | 490 | 4.0 seconds |
| 5 | 1500 | 735 | 5.0 seconds |
| 6 | 1500 | 735 | 5.5 seconds |
| 7 | 2300 | 1126 | 8.0 seconds |
| 8 | 3400 | 1665 | 14 seconds |
| 9 | 4100 | 2008 | 16 seconds |
| 10 | 4200 | 2057 | 15.5 seconds |
| 11 | 3200 | 1567 | 11.5 seconds |
| 12 | 3200 | 1567 | 14 seconds |

Figure 4:
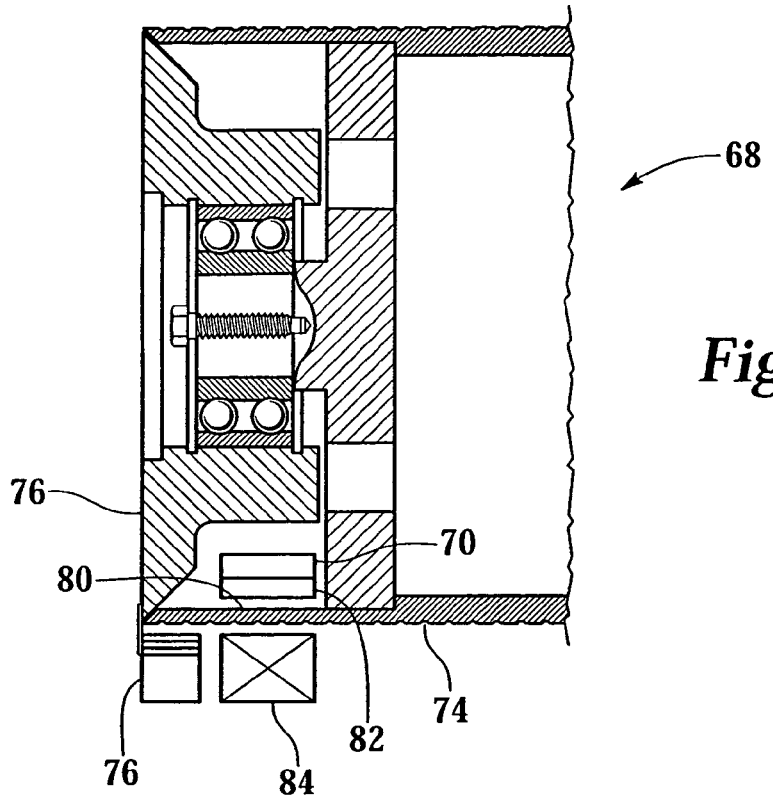
FIG. 4 is a side elevational cross-sectional view of an alternative embodiment roll and roll brake of the invention.
Figure 5:
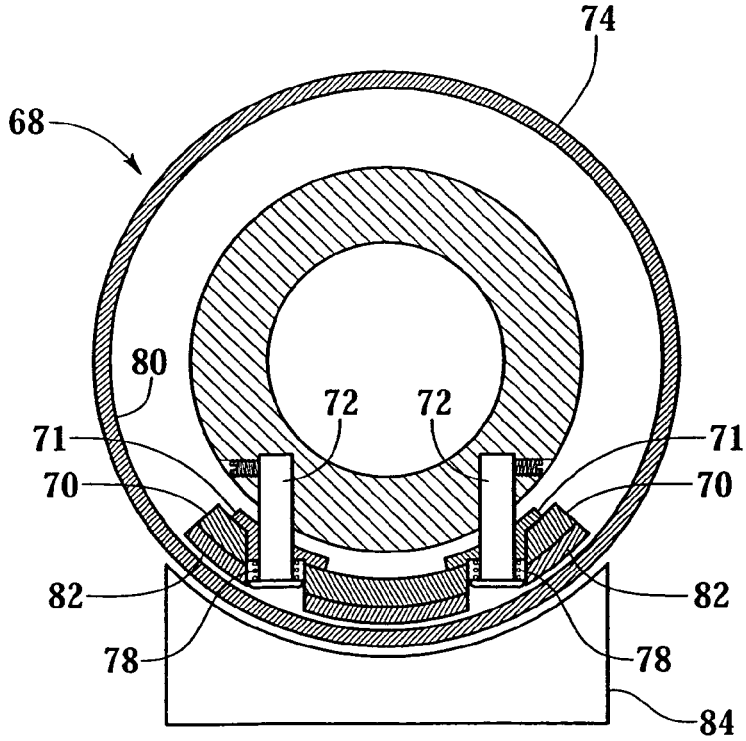
FIG. 5 is a cross-sectional view of the alternative roll and roll brake of FIG. 4, taken along section line 5—5.

An alternative embodiment roll brake apparatus 68 is shown in FIGS. 4 and 5. A brake shoe 70 is mounted by guide bushings 71 to a pair of guide pins 72 which are mounted to a roll support bracket 76 and are internal to the roll shell 74. The brake shoe 70 is biased in by springs 78 away from the inside surface 80 of the roll shell 74. The brake shoe 70 has a lining 82 which faces the inside surface of the roll shell. The brake shoe 70 may be a ferromagnetic material or may have mounted to it a ferromagnetic material or a permanent magnet. An external electromagnet 84 is positioned outside the roll shell 74. When the electromagnet 84 is turned on, it draws the brake shoe 70 downwardly toward the roll shell 74, bringing the brake lining 82 into engagement with the inside surface 80 to produce a frictional braking force of 20 to 30 pounds.

It should be understood that the electromagnet will function better the closer it is to the rolls surface in both described embodiments, because this will minimize the distance, i.e. the air gap, between the electromagnet the object it is action on. However misalignments and deflections limit how close the electromagnet can be to the roll surface in practice, for example the gap between the roll and the magnet could be about 0.1 inches or less.

It should be understood that the brake apparatus 68 and the magnetic brake 38 could be used in any kind of paper handling machine where is desirable to bring low inertia idler rolls to a stop so that the roll does not present a hazard to an operator who approaches the machine after it has been shut down.

It should be understood that the rolls 30 could be constructed of any material so long as eddy currents are produced which results in a braking actions on the roll.

It is understood that the invention is not limited to the particular construction and arrangement of parts herein illustrated and described, but embraces all such modified forms thereof as come within the scope of the following claims.

We claim:

1. An idler roll in a paper handling machine, comprising:

a paper web, passing through the paper handling machine;

at least one idler roll, having a cylindrical shell positioned so that the paper web contacts the cylindrical shell of the idler roll, the at least one idler roll mounted to be rotated about an axis by the action of the web of paper traveling in contact with the cylindrical shell of the idler roll; and an electromagnet mounted closely spaced from the cylindrical shell, the electromagnet being of a selected strength so that when the electromagnet is energized it produces an eddy current in the cylindrical shell selected to bring the roll to a stop in less than about one minute.

2. The apparatus of claim 1 wherein the idler roll cylindrical shell is constructed of aluminum.

3. A method of braking an idler roll in a paper handling machine, comprising:

drawing a paper web across a conductive outer shell of an idler roll; and if the paper web breaks, energizing an electromagnet mounted closely spaced from the conductive outer shell on which the paper web runs to thereby induce eddy currents in the conductive shell of the roll to produce a braking action on the shell.

4. The method of claim 3 wherein the idler roll is brought to a stop within one minute.

5. The apparatus of claim 4 wherein the idler roll cylindrical shell is constructed of aluminum.

6. An idler roll in a slitter, comprising:

a plurality of slitter blades;

a plurality of bottom bands, wherein the slitter blades are positionable with respect to the bottom bands to slit a web of paper;

at least one idler roll, having a cylindrical shell positioned upstream of the slitter blades, mounted to be rotated about an axis by the action of the web of paper traveling in contact with the cylindrical shell of the idler roll; and an electromagnet positioned external to and mounted closely spaced from the cylindrical shell, the electromagnet being of a selected strength so that when the electromagnet is energized it produces an eddy current in the cylindrical shell selected to bring the roll to a stop in less than about one minute.

7. A method of braking an idler roll in a slitter, comprising:

drawing a paper web across a conductive outer shell of an idler roll and passing the web to a plurality of slitter blades; and if the paper web breaks, energizing an electromagnet mounted closely spaced from the conductive outer shell to induce eddy currents in the conductive shell of the roll to produce a braking action on the shell.

8. The method of claim 7 wherein the electromagnet generates a magnetic field of a strength selected to bring the idler roll to a stop within one minute.

* * * * *